US005181362A

United States Patent [19]

Benitez

[11] Patent Number: 5,181,362

[45] Date of Patent: Jan. 26, 1993

[54] INTERLOCKING BUILDING BLOCKS

[76] Inventor: Rafael C. Benitez, 390 NW. 2nd St., Apt. 806, Miami, Fla. 33128

[21] Appl. No.: 760,575

[22] Filed: Sep. 16, 1991

[51] Int. Cl.[5] ..... E04C 1/00

[52] U.S. Cl. ..... 52/594; 52/589; 52/593; 52/578

[58] Field of Search ..... 52/593, 594, 592, 589, 52/578

[56] References Cited

U.S. PATENT DOCUMENTS 1,704,255 2/1926 Lewis ..... 52/589
3,102,367 9/1957 Pedersen et al. ..... 52/594

*Primary Examiner*—David A. Scherbel
*Assistant Examiner*—Wynn E. Wood
*Attorney, Agent, or Firm*—Malloy, Downey & Malloy

[57] ABSTRACT

An interlocking building block, to be used in constructing walls and building frames, the building blocks being adapted to be securely engaged without the need to use extra layers of cement. The interlocking building blocks include a series of ridges and channels disposed along the top and bottom surface of the block and at opposite distal ends, which are structured and disposed to be correspondingly fitted with the ridges and channels of adjoining blocks, thereby forming a secure interlocking structure.

9 Claims, 4 Drawing Sheets

INTERLOCKING BUILDING BLOCKS

BACKGROUND OF THE INVENTION

1. Field of the Invention

This invention relates to an interlocking building block adapted to be correspondingly engaged with adjoining interlocking building blocks, thereby forming a secure, stable structure which may be quickly erected using smaller than usual quantities of cement.

2. Description of the Prior Art

The standard cinder block has for a long time been the primary building unit in many types of construction. The manner in which the cinder blocks are utilized has remained unchanged over time, and the building steps used today are basically the same as those used years ago. This common practice involves pouring an initial layer of cement wherein the first row of cinder blocks may be embedded. Following this initial base layer, a thin layer of cement must be spread along the top surface and both the left and right side surfaces. This layer of cement must be thin enough to allow the blocks to remain properly leveled and positioned, but must also be thick enough to secure the block as positioned. Finally, an upper layer of cement is laid, and usually, the exterior surface is covered with a layer of cement to provide a stable structure. Unfortunately, the intermediate step of putting a layer of cement between each of the individual blocks can be very time-consuming, costly, and leaves much room for error when constructing a uniformly oriented structure.

Other attempts have been made to design an interlocking building block, but as is evidenced by the continued use of a standard shaped cinder block, have not been effectively or widely accepted as beneficial. The two major types of design flaws with prior attempts to build an interlocking building block are either that the block is too difficult and expensive to construct, or that it is too difficult and time-consuming to place. The patents to J. Cook, U.S. Pat. No. 460,177, Vesper, U.S. Pat. No. 2,688,245, Amaral, U.S. Pat. No. 4,258,522, Risi, et al., U.S. Pat. No. 4,601,148, and Schwartz, U.S. Pat. No. 4,627,209, disclose attempts to make an effective and beneficial interlocking building block. The prime difficulty with many of these designs, particularly Cook, Vesper, Amaral, and Risi, et al., involves the lack of positionability of the blocks. All of these designs involve a complex series of interlocking sides and protruding surfaces which allow the blocks to be stacked only in a predetermined orientation by maneuvering the blocks until the plurality of interconnecting parts are engaged. Further, the designs disclosed in Cook and Amaral, have solid faces which do not allow the internal interconnection of the blocks, which is invaluable for wiring and insulating needs. The lack of widespread use of these various designs indicates the importance of the particular design characteristics not met by the referenced designs.

Applicant's invention as claimed utilizes interlocking ridges and channels which extend across the entire length of the block, thereby allowing the block to be easily slid into place oriented in any manner with regard to the block's beneath it. Additionally, applicant's invention enables the manufacture of a stable structure without the need for excess layers of cement, while assuring that the surfaces of the block, in particular, the exposed surfaces, are as smoothly and uniformly oriented as those of common cinder blocks, which many structures are designed to use. Accordingly, applicant's invention provides a beneficial improvement in the structure of construction blocks, and utilizes interlocking means which specifically overcome the shortcomings of other types of blocks.

SUMMARY OF THE INVENTION

The present invention is directed towards an interlocking building block to be used to more efficiently and effectively construct walls, supports, and other similar structures which normally utilize standard building blocks. The interlocking building block, which is equivalently sized with standard building blocks, is comprised primarily of a rigid solid block designed to be interconnectedly positioned with a like rigid, solid block. Each individual block includes at least one elongate rounded ridge along its top, and at least one elongate rounded channel on its bottom surface. The elongate, rounded ridge along the top surface is specifically designed to be easily and securely fitted within the elongate, rounded channel in the bottom surface of an adjoiningly stacked block, creating a securely stacked structure. The interconnecting block also contains at least one transverse bore through which insulation and wiring may be passed. Additionally, the block contains a rounded, vertical, cutout channel and a rounded, vertical, protruding ridge, both of which extend from the block's top surface to its bottom surface along different sides of the block. The rounded, vertical, protruding ridge of one block is structured and disposed to be positioned within the rounded, vertical, cutout channel of an adjacently positioned block.

There are various different embodiments using the stated design features, each of which is designed to facilitate a particular part of the construction process. In particular, and in addition to the basic design, there are embodiments specifically directed to, provide shorter end blocks when a full-sized block is not needed, provide an easy means of constructing thinner partition walls extending from an exterior frame, provide a facilitated means of constructing doorways, windows and arches, and providing easily made squared and rounded corners.

BRIEF DESCRIPTION OF THE DRAWINGS

For a fuller understanding of the nature of the present invention, reference should be had to the following detailed description taken in connection with the accompanying drawings in which.

DETAILED DESCRIPTION OF THE PREFERRED EMBODIMENT

Figure 1:
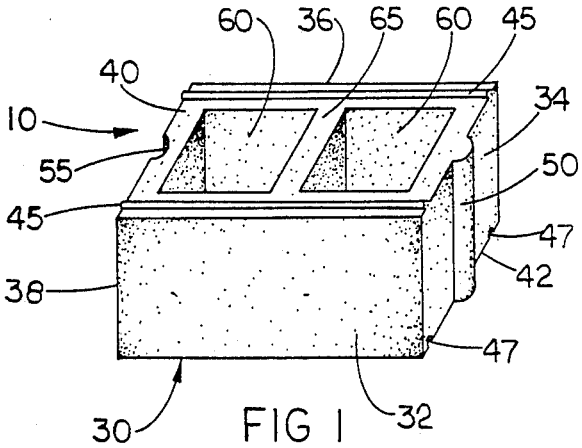
FIG. 1 is a perspective view of the standard model of the interlocking building block.
Figure 1A:
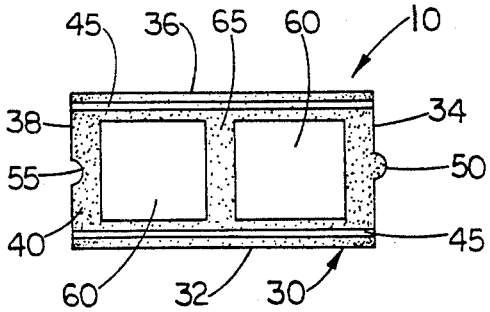
FIG. 1A is a top view of the standard model of the interlocking building block.
Figure 1B:
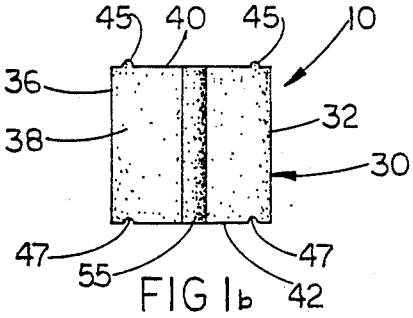
FIG. 1B is an end view of the standard model of the interlocking building block.
Figure 1C:
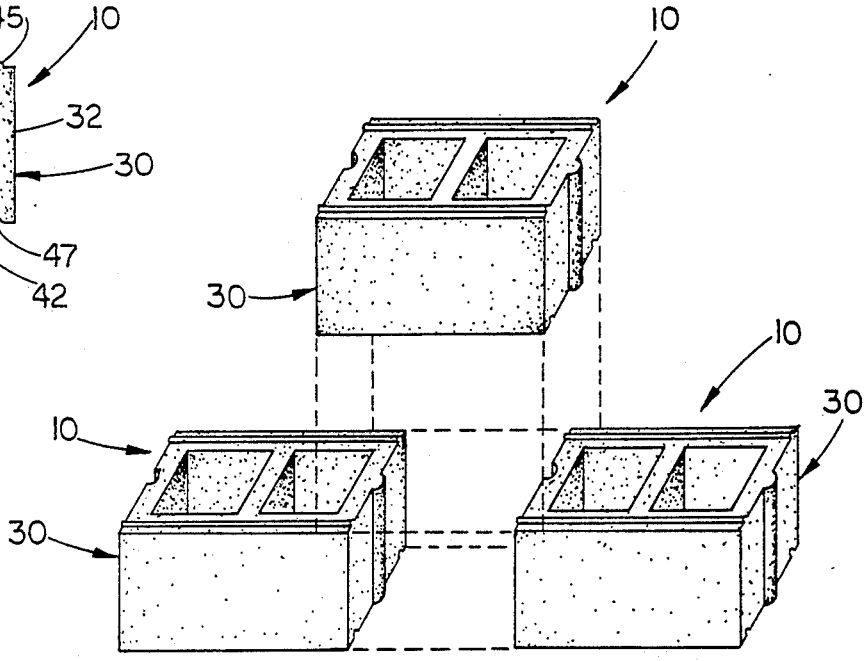
FIG. 1C is an exploded view of the interlocking arrangement of the standard model of the interlocking building blocks.

Depicted throughout FIGS. 1-9 are various embodiments of the applicant's invention as claimed. Turning to FIG. 1, the standard model of the interlocking building block 10 is comprised primarily of a rectangular block 30 having a front surface 32, a right surface 34, a rear surface 36, a left surface 38, a top surface 40, and a bottom surface 42. Adjacently disposed along the top surface 40 are two transverse bores 60 which pass through the top surface 40 and the bottom surface 42. As best seen in FIG. 1 and IA, there is a vertical, rounded, cutout channel 55 in the left face 38, which extends from the top surface 40 to the bottom surface 42 and is substantially centered between the rear surface 36 and the front surface 32. On said right face 34 is a vertical, rounded, protruding ridge 50 which extends from the top surface 40 to the bottom surface 42 and is also substantially centered between the rear surface 36 and the front surface 32. Extending along the top surface 40 from the left surface 38 to the right surface 34 are two elongate, rounded protruding ridges 45, best shown in FIGS. 1 and 1B, which are positioned on opposite sides of said transverse bores 60. In the bottom surface 42, and extending from the left surface 38 to the right surface 34 are two elongate, rounded, cutout channels 47, which are positioned on opposite sides of said transverse bores 60. As shown in FIG. 1C, the blocks are designed so that the vertical, rounded, protruding ridge 50 on the right surface 34 of one block 30 will engagedly fit within the vertical, rounded, cutout channel 55 in the left surface 38 of a second block 30. Additionally, the elongate, rounded, protruding ridges 45 are structured so as to be securely fitted within the elongate, rounded, cutout channels 47 on the bottom surface 42 of an adjacently stacked block 30.

Figure 2:
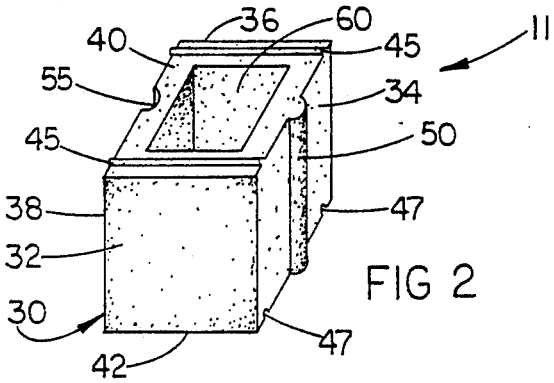
FIG. 2 is a perspective view of a shortened standard model of the interlocking building blocks.

Shown in FIG. 2 is a shortened end block 11, which only includes one transverse bore 60, and has a front surface 32, a top surface 40, a rear surface 36, and a bottom surface 42, which are generally half the length of those in the standard model of the interlocking building block 10.

Figure 3:
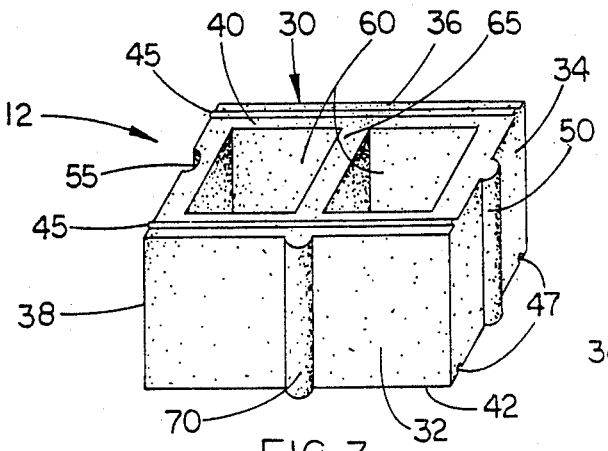
FIG. 3 is a perspective view of a standard model of the interlocking building block having a side protruding ridge for partition extension.

Referring to FIG. 3, a second, vertical, rounded, protruding ridge 70 is positioned on the front face 32, extending from the top surface 40 to the bottom surface 42, and substantially centered between the left surface 38 and the right surface 34, thereby forming a standard model interlocking building block with a partition extension, generally indicated as 12.

Figure 4A:
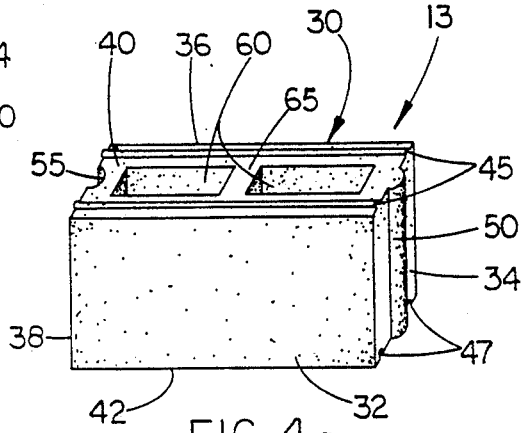
FIG. 4A is a perspective view of a narrow partition interlocking building block.
Figure 4B:
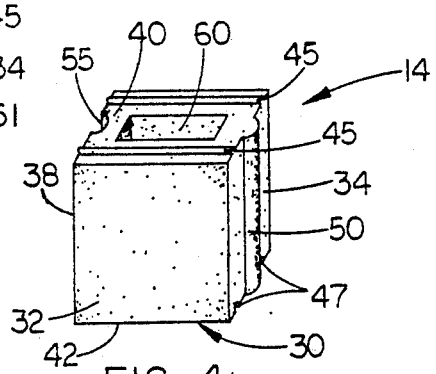
FIG. 4B is a perspective view of a shortened, narrow partition interlocking building block.

Depicted in FIGS. 4A and 4B are partition block 13 and shortened, narrow partition block 14, respectively. The narrow partition block 13, has its left surface 38 and its right surface 34 at generally one-half the width of the left surface 38 and the right surface 34 of the standard model interlocking building block 10. The shortened, narrow partition block 14 has the same sized left surface 38 and right surface 34 as the narrow partition block 13, and further has its front surface 32, top surface 40, rear surface 36, and bottom surface 42 at generally one-half the length of those in the standard model interlocking building block 10.

Figure 5:
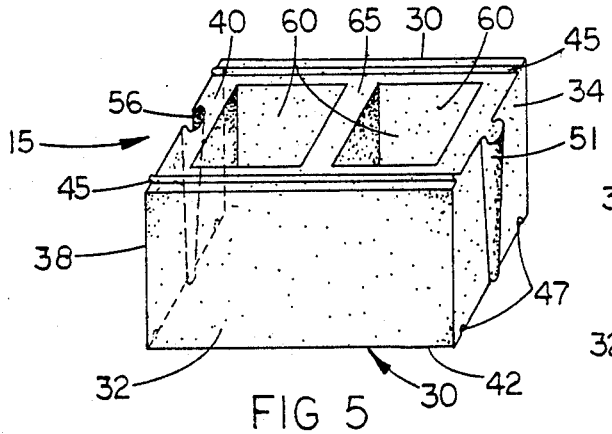
FIG. 5 is a perspective view of a door frame, window frame or archway interlocking building block.
Figure 5A:
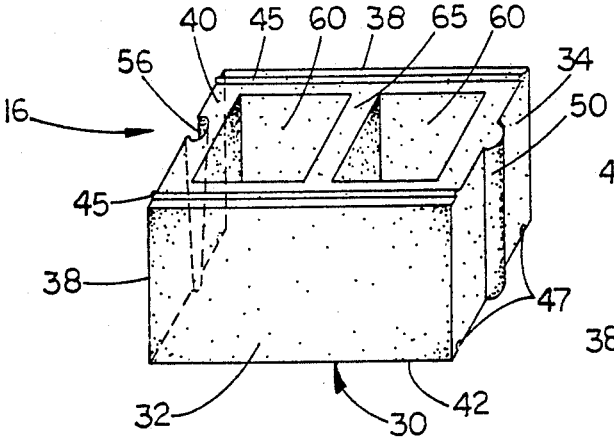
FIG. 5A is a perspective view of a right side transition block used for changing from the standard model block to the archway type block.
Figure 5B:
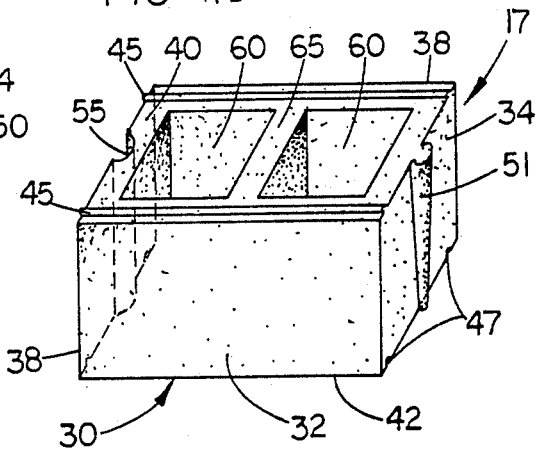
FIG. 5B is a left side transition block used for changing from the archway type block back to the standard type block.
Figure 6A:
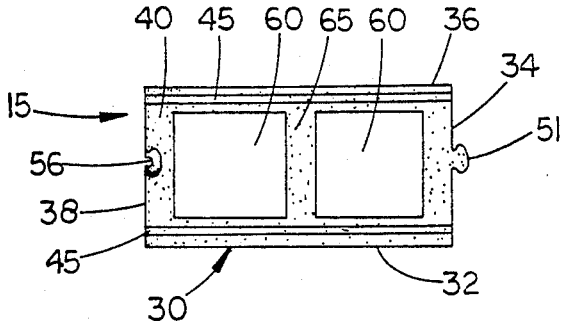
FIG. 6A is a top view of the archway type interconnecting block.
Figure 6C:
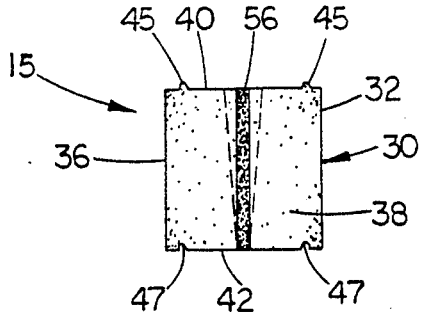
FIG. 6C is a left side view of the archway type interconnecting block.
Figure 6B:
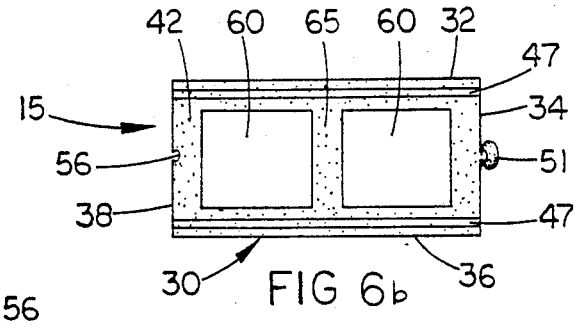
FIG. 6B is a bottom view of the archway type interconnecting block.
Figure 6D:
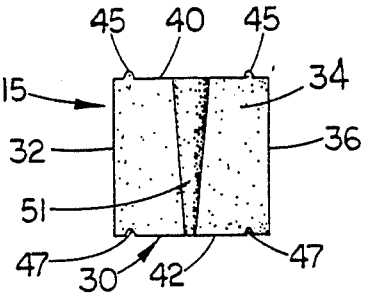
FIG. 6D is a right side view of the archway type interconnecting block.
Figure 7:
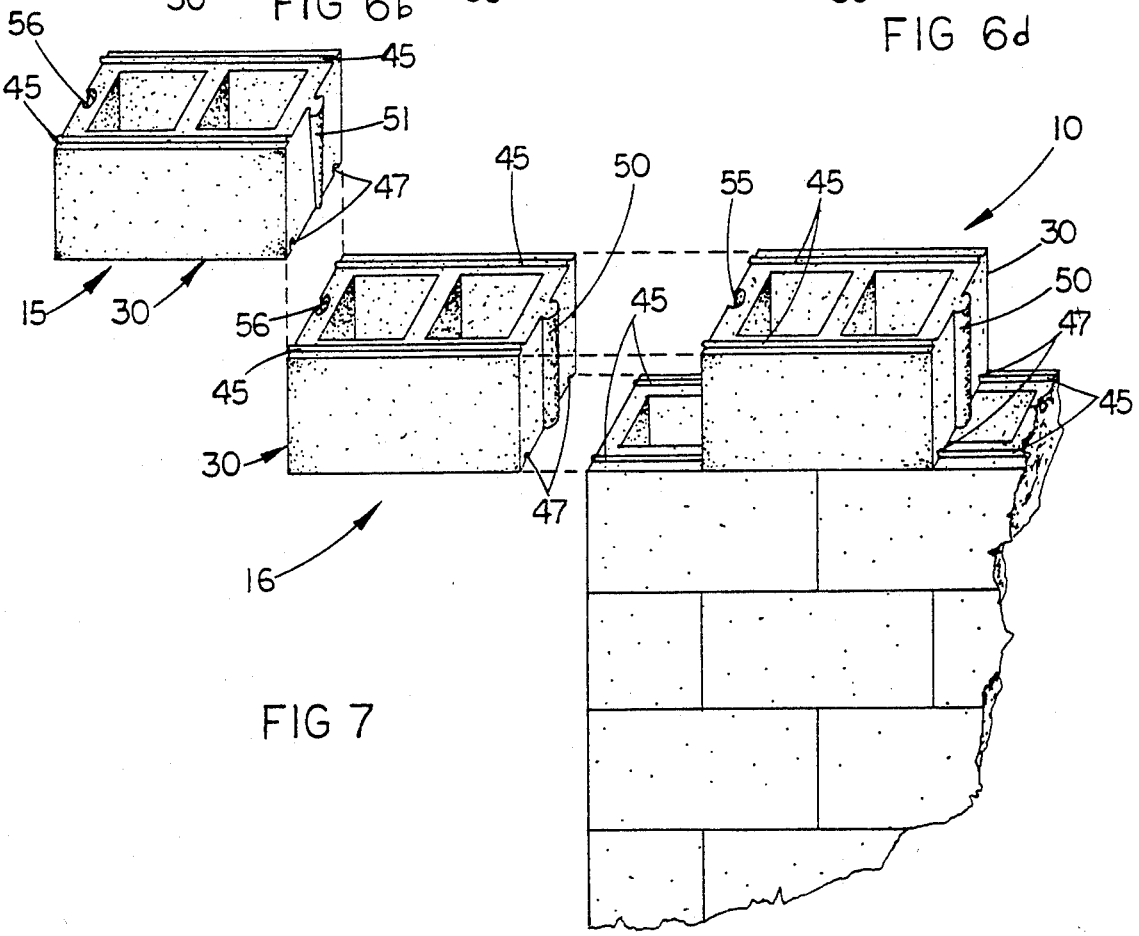
FIG. 7 is a partially exploded view of an archway construction.

Shown in FIGS. 5, 5A and 5B, are embodiments specifically directed towards facilitating the formation of door frames or archways. The three types of blocks included, are the archway block 15, the right side transition block 16, and the left side transition block 17. The transition blocks 16 and 17 are utilized to enable a builder to use the standard model interlocking building block 10 until a doorway, arch or window is needed. Located on the left surface 38 of the archway block 15 and the right side transition block 16 is a tapered, vertical, rounded, cutout channel 56, located on the right surface 34 of the archway block 15 and the left side transition block 17 is a tapered, vertical, rounded, protruding ridge 51. As best shown in the various views of the archway block 15 of FIGS. 6A, 6B, 6C and 6D, the tapered, vertical, rounded, cutout channel 56 is tapered such that its widest point is at the top surface 40 and its narrowest point is at the bottom surface 42. Additionally, the tapered, vertical, rounded, cutout channel 56 is tapered in width such that its narrowest point is at the left surface 38 and its widest point is within the block 30. The tapered, vertical, rounded, protruding ridge 51 is also tapered such that its widest point is at the top surface 40 and its narrowest point is at the bottom surface 42, and is tapered in cross-sectional width such that a narrowest point is at the right surface 34 and a widest portion is outside the block 30. As detailed in FIG. 7, the tapered, vertical, rounded, protruding ridge 51 is structured so as to be slidably and securely positioned within the tapered, vertical, rounded, cutout channel 56 of an adjacently positioned block 30.

Figure 8:
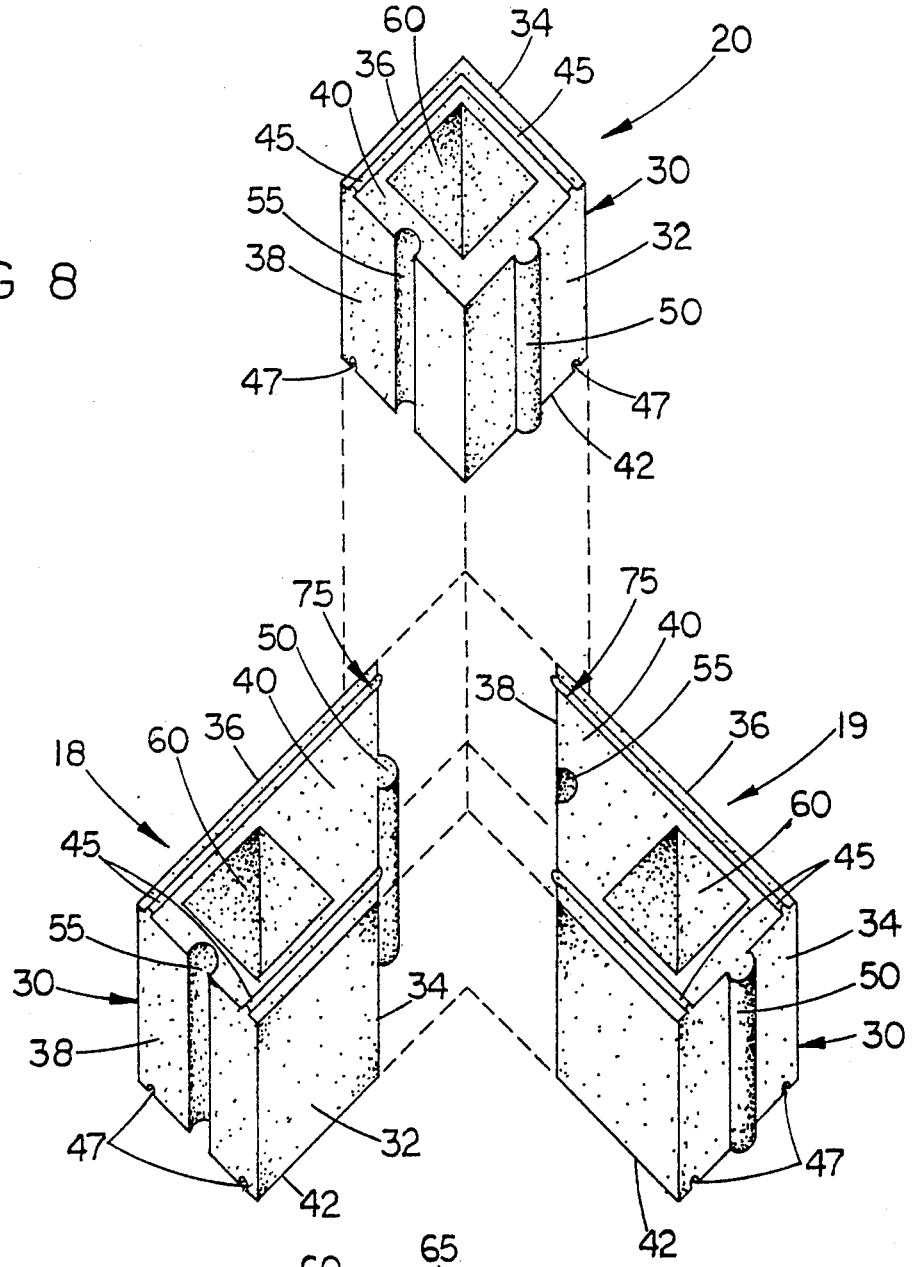
FIG. 8 is an exploded view of a squared corner assembly.

Turning to FIG. 8, are a plurality of blocks 18, 19, and 20 designed to facilitate the formation of a squared corner. The first angled corner unit 18, has only one transverse bore 60, and has its right surface 34 angled with relation to its rear surface 36 so as to form a 45° angle 75. This first angled corner unit 18 is designed to be fitted with a second angled corner unit 19 which has its left surface 36 angled with relation to its rear surface 30 to form a 45° angle 75. When fitted together, the first angled corner unit 18 and the second angled corner unit 19 form a 90° corner which may be capped by a squared corner block 20. The squared corner block 20 has its vertical, rounded, protruding ridge 50, located on its front face 32, extending from the top surface 40 to the bottom surface 42 and substantially centered between the left surface 38 and the right surface 34. Additionally, the elongate, rounded, protruding ridges 45, are located on the top surface 40 along a length defined by the rear surface 36 and the right surface 34. The elongate, rounded, cutout channels 47 are located in the bottom surface 42 along a length defined by the rear surface 36 and the right surface 34. Accordingly, the squared corner block 20 may be easily fitted on top of the joined first angled corner unit 18 and second angled corner unit 19.

Figure 9:
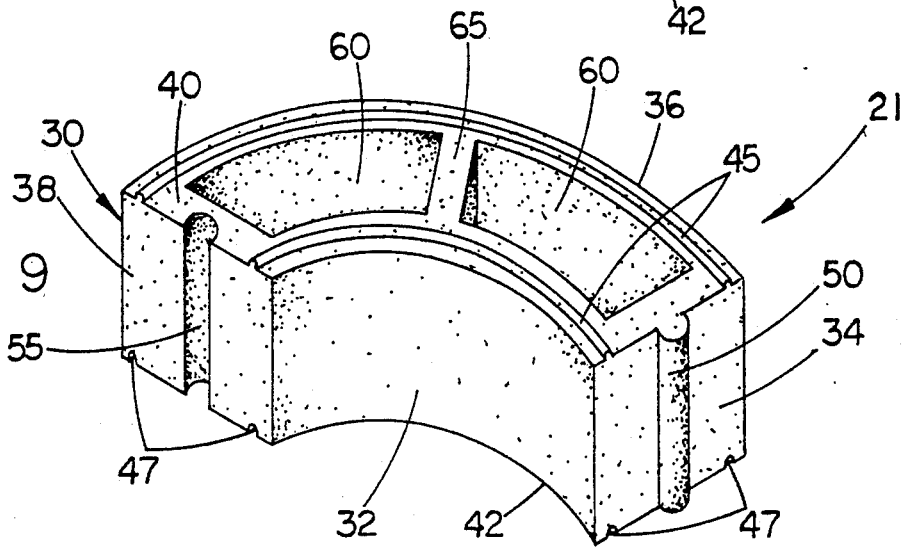
FIG. 9 is a perspective view of a rounded corner assembly.

Shown in FIG. 9 is a rounded corner block 21. The rounded corner block 21, has its top surface 40, rear surface 36, bottom surface 42, and front surface 32 substantially curved so as to facilitate the formation of a rounded corner.

The various embodiments of applicant's invention employ the same basic interlocking means, and may be formed of various materials and in various sizes, thereby enabling their use in full scale construction as well as model construction.

Now that the invention has been described,

What is claimed is:

1. An interlocking building block system comprising:

a plurality of rigid, sturdy blocks including at least one standard block, at least one squared corner block, and at least two angled corner units, each of said blocks including a top surface, a bottom surface, and four outer faces including a front face, a rear face, a left face, and a right face, and at least one transverse bore passing through said top surface and said bottom surface, said bottom surface including at least one elongate, rounded, cutout channel, said top surface including at least one elongate, rounded, protruding ridge structured and disposed to be correspondingly positioned in engaging, securing relation within said elongate, rounded, cutout channel in an adjacently stacked one of said blocks, said outer faces further including at least one rounded, vertical, cutout channel extending from said top surface to said bottom surface and positioned in said left face in a substantially centered position between said front face and said rear face, said outer faces also including at least one rounded, vertical, protruding ridge extending from said top surface to said bottom surface and being structured and disposed to be correspondingly fitted, in engaging, securing position within said rounded, vertical, cutout channel of an adjacently positioned one of said blocks, said standard block and said angled corner units including said rounded, vertical, protruding ridge positioned on said right face in a substantially centered position between said front face and said rear face, said top surface of said standard block and said angled corner units including two of said elongate, rounded, protruding ridges extending from said left face to said right face, each of said elongate, rounded, protruding ridges being on opposite sides of said transverse bore, said bottom surface of said standard block and said angled corner units including two of said elongate, rounded, cutout channels extending from said left face to said right face, each of said elongate, rounded, cutout channels being on opposite sides of said transverse bore, said front face of at least one of said standard blocks including a rounded, protruding ridge, extending from said top surface to said bottom surface in substantially centered relation between said left face and said right face, said ridge being adapted to be fitted within the vertical rounded, channel of a perpendicularly positioned one of said blocks, said angled corner units including a first angled corner unit and a second angled corner unit for use in the formation of a 90° squared corner, said right face of said first angled corner unit being angled so as to form a generally 45° angle with said rear face, and said left face of said first angled corner unit being generally perpendicular to said front face and said rear face, said left face of said second angled corner unit being angled so as to form a generally 45° angle with said rear face, and said right face of said second angled corner unit being generally perpendicular to said front face and said rear face, said left face of said second angled corner unit being structured and disposed to be fitted with said right face of said first angled corner unit so as to form said 90° squared corner, said squared corner unit being generally square, and said rounded, vertical, protruding ridge being positioned on said front face in a substantially centered position between said left face and said right face, said squared corner unit including two of said rounded protruding ridges along said top surface thereof, said ridges being perpendicularly positioned along a length defined by said rear face and a length defined by said right face, thereby allowing the facilitated positioning of said angled corner units thereon, and said squared corner unit including two of said rounded cutout channels along said bottom surface thereof, said channels being perpendicularly positioned along said length defined by said rear face and said length defined by said right face, thereby allowing said squared corner block to be securely placed atop said angled corner units.

2. An interlocking building block system as recited in claim 1 wherein said standard block contains two of said transverse bores, adjacently positioned so as to define a support wall extending from said front face to said rear face.

3. An interlocking building block system as recited in claim 2, wherein said standard block is generally rectangular.

4. An interlocking building block system as recited in claim 1 wherein said standard block is generally square.

5. An interlocking building block system as recited in claim 1 wherein said left face and said right face of said standard block are generally narrow in width, thereby providing a substantially narrow one of said standard blocks to facilitate the formation of a partition-type division.

6. An interlocking building block system as recited in claim 1 wherein said rounded, vertical, cutout channel in said left face is tapered from a widest point at said top surface to a narrowest point at said bottom surface, and is further tapered in cross-sectional width from a narrowest point at said left face to a widest point within said block.

7. An interlocking building block system as recited in claim 6 wherein said rounded, vertical, protruding ridge in said right face is tapered from a widest point at said top surface to a narrowest point at said bottom surface, and is further tapered in cross-sectional width from a narrowest point at said right face to a widest point outside of said block, such that said rounded, vertical, protruding ridge may be slid into secure, interlocking, non-sliding, flushed position inside a correspondingly tapered one of said rounded, vertical, cutout channels of an adjacently positioned one of said blocks.

8. An interlocking building block system as recited in claim 1 wherein said front face, said rear face, said top surface, and said bottom surface are substantially curved along their length, so as to form a curved one of said standard blocks, which will facilitate the making of rounded corners.

9. An interlocking building block system as recited in claim 1 wherein said rounded, vertical, protruding ridge in said right surface is tapered from a widest point at said top surface to a narrowest point at said bottom surface, and is further tapered in cross-sectional width from a narrowest point at said right surface to a widest point outside of said block, such that said rounded, vertical, protruding ridge may be slid into secure, interlocking, non-sliding, flushed position inside said correspondingly tapered one of said rounded, vertical, cutout channel of an adjacently positioned one of said blocks.

* * * * *